United States Patent [19]

Butterworth et al.

[11] Patent Number: 4,555,349

[45] Date of Patent: Nov. 26, 1985

[54] FABRIC SOFTENING COMPOSITIONS

[75] Inventors: Robert M. Butterworth; Martin A. Wells, both of Wirral, England

[73] Assignee: Lever Brothers Company, New York, N.Y.

[21] Appl. No.: 594,584

[22] Filed: Mar. 29, 1984

[30] Foreign Application Priority Data

Apr. 8, 1983 [GB] United Kingdom ..... 8309664

[51] Int. Cl.[4] ..... C11D 1/62; C11D 3/20

[52] U.S. Cl. ..... 252/8.6; 8/137

[58] Field of Search ..... 252/8.6; 8/103, 137

[56] References Cited

U.S. PATENT DOCUMENTS

| | | | |
|---|---|---|---|
| 3,519,561 | 7/1970 | Kelly | 252/8.8 |
| 4,069,159 | 1/1978 | Hayek | 252/8.8 |
| 4,127,489 | 11/1978 | Pracht et al. | 252/8.8 |
| 4,308,024 | 12/1981 | Wells | 8/137 |
| 4,417,995 | 11/1983 | Lips et al. | 252/174.23 |
| 4,445,901 | 5/1984 | Beavan | 8/103 |

FOREIGN PATENT DOCUMENTS

| | | |
|---|---|---|
| 2085 | 5/1979 | European Pat. Off. . |
| 13780 | 8/1980 | European Pat. Off. . |
| 79643 | 5/1983 | European Pat. Off. . |
| 1487432 | 9/1977 | United Kingdom . |
| 1571527 | 7/1980 | United Kingdom . |

*Primary Examiner*—A Lionel Clingman

*Attorney, Agent, or Firm*—Lynne Darcy; James J. Farrell

[57] ABSTRACT

A liquid fabric softening composition contains (i) an aqueous base;

(ii) a water-insoluble cationic fabric softener such as a quaternary ammonium salt or an imidazolinium salt;

(ii) a nonionic material having an HLB of not more than 10 such as fatty acids, fatty esters of monohydric or polyhydric alcohols and fatty alcohols, the ratio of the cationic to nonionic materials being less than 5:1; and (iv) an electrolyte selected from salts of lithium, calcium, magnesium and aluminium.

The specified electrolytes improve the stability of the composition.

6 Claims, No Drawings

FABRIC SOFTENING COMPOSITIONS

The present invention relates to fabric softening compositions, in particular concentrated liquid fabric softening compositions containing water-insoluble cationic fabric softening agents and fatty acids or other nonionic materials with a low HLB.

It is known from GB No. 2 039 556 (UNILEVER—Case C.567) to form aqueous liquid fabric softening compositions containing up to 20% of a mixture of a water-insoluble cationic material and fatty acid, the fatty acid acting to improve the efficiency of softening, thereby enabling the level of the cationic material to be reduced without loss of performance. It is also known from EP No. 13780 (PROCTER & GAMBLE) to form concentrated aqueous liquid fabric softening compositions from a mixture of a water-insoluble cationic material and relatively low levels of a nonionic material selected from hydrocarbons, fatty acids, fatty esters and fatty alcohols, the nonionic material acting to improve the viscosity characteristics of the product when the level of cationic material is above 8%. It is also known from GB No. 2 039 556 that preferred compositions can also include low levels of sodium chloride to further control product viscosity.

It may be desirable to form concentrated rinse conditioners using a mixture of cationic and nonionic materials, where the level of the nonionic material is higher than taught by EP No. 13780, ie where the weight ratio of cationic material to nonionic material is less than 5:1.

Thus, it may be desirable to partially replace the cationic fabric softening agent with a material which is less costly, easier to handle or less prone to causing skin reaction while at the same time maintaining the performance of the product. At cationic to nonionic ratios below 5:1 we have now surprisingly discovered that the storage stability of products is acceptable, if specific electrolytes other than sodium chloride, are included.

Thus, according to the invention there is provided a concentrated liquid fabric softening composition comprising an aqueous base, at least 8% by weight of a water-insoluble cationic fabric softening agent, an electrolyte and at least 1.6% by weight of a nonionic material having an HLB of not more than 10, the weight ratio of the cationic fabric softening agent to the nonionic material being less than 5:1 and the nonionic material being selected from:

(i) $C_8$–$C_{24}$ fatty acids;

(ii) esters of $C_8$–$C_{24}$ fatty acids with monohydric alcohols containing 1–3 carbon atoms;

(iii) $C_{10}$–$C_{18}$ fatty alcohols; and (iv) fatty acid esters of $C_2$–$C_8$ polyhydric alcohols, the composition being characterised in that the electrolyte is selected from salts of lithium, calcium, magnesium and aluminium.

The water-insoluble cationic fabric softener can be any fabric-substantive cationic compound that has a solubility in water at pH 2.5 and 20° C. of less than 10 g/l. Highly preferred materials are quaternary ammonium salts having two $C_{12}$–$C_{24}$ alkyl or alkenyl chains, optionally substituted or interrupted by functional groups such as —OH, —O—, —CONH, —COO—, etc.

Well known species of substantially water-insoluble quaternary ammonium compounds have the formula

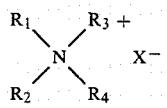

wherein $R_1$ and $R_2$ represent hydrocarbyl groups of from about 12 to about 24 carbon atoms; $R_3$ and $R_4$ represent hydrocarbyl groups containing from 1 to about 4 carbon atoms; and X is an anion, preferably selected from halide, methyl sulfate and ethyl sulfate radicals. Representative examples of these quaternary softeners include ditallow dimethyl ammonium chloride; ditallow dimethyl ammonium methyl sulfate; dihexadecyl dimethyl ammonium chloride; di(hydrogenated tallow alkyl)dimethyl ammonium chloride; dioctadecyl dimethyl ammonium chloride; dieicosyl dimethyl ammonium chloride; didocosyl dimethyl ammonium chloride; di(hydrogenated tallow)dimethyl ammonium methyl sulfate; dihexadecyl diethyl ammonium chloride; di(coconut alkyl)dimethyl ammonium chloride. Ditallow dimethyl ammonium chloride, di(hydrogenated tallow alkyl)dimethyl ammonium chloride, di(coconut alkyl)dimethyl ammonium chloride and di(coconut alkyl)dimethyl ammonium methosulfate are preferred.

Another class of preferred water-insoluble cationic materials are the alkylimidazolinium salts believed to have the formula:

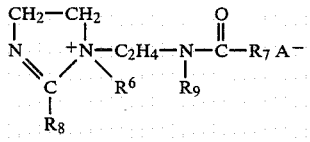

wherein $R_6$ is an alkyl or hydroxyalkyl group containing from 1 to 4, preferably 1 or 2 carbon atoms, $R_7$ is an alkyl or alkenyl group containing from 8 to 25 carbon atoms, $R_8$ is an alkyl or alkenyl group containing from 8 to 25 carbon atoms, and $R_9$ is hydrogen or an alkyl containing from 1 to 4 carbon atoms and $A^-$ is an anion, preferably a halide, methosulfate or ethosulfate. Preferred imidazolinium salts include 1-methyl-1-(tallowylamido-)ethyl-2-tallowyl-4,5-dihydro imidazolinium methosulfate and 1-methyl-1-(palmitoylamido)ethyl-2-octadecyl-4,5-dihydroimidazolinium chloride. Other useful imidazolinium materials are 2-heptadecyl-1-methyl-1-(2-stearylamido)-ethyl-imidazolinium chloride and 2-lauryl-1-hydroxyethyl-1-oleyl-imidazolinium chloride. Also suitable herein are the imidazolinium fabric softening components of U.S. Pat. No. 4,127,489, incorporated by reference.

The level of water-insoluble cationic fabric softening agent in the composition should be at least 8% by weight, such as between 8% and 22% by weight. Above 22% by weight, especially above 26%, products with an acceptable viscosity may be more difficult to make even in spite of the contribution towards viscosity control which is obtained from the nonionic material. When particularly high concentrations are desired, it is preferred to use an imidazolinium softener and preferred compositions contain from 12% to 26% of imidazolinium softener. When a di-long chain noncyclic monoquaternary softener is employed, it is preferred not to exceed a level of 22%, and a preferred range is 10% to 18%.

The compositions further contain specific nonionic materials having an HLB of not more than 10, preferably not more than 8. The HLB scale is a known measure of the hydrophylic-lipophilic balance in any compound and can be determined from trade literature. Nonionic materials having a lower HLB value are less hydrophilic than those having higher HLB values.

The nonionic materials are selected from (i) $C_8$–$C_{24}$ fatty acids;

(ii) esters of $C_8$–$C_{14}$ fatty acids with monohydric alcohols containing 1–3 carbon atoms;

(iii) $C_{10}$–$C_{18}$ fatty alcohols; and (iv) fatty acid esters of $C_2$–$C_8$ polyhydric alcohols.

Particularly preferred examples of such nonionic materials include lauric acid, myristic acid, palmitic acid, stearic acid, oleic acid, linoleic acid, undecanoic acid, methyl laurate, ethyl myristate, ethyl stearate, methyl palmitate, dodecanol, tetradecanol, hexadecanol, octadecanol, ethylene glycol monostearate, and glycerol monostearate.

The level on nonionic material present in the compositions of the invention is at least 1.6%, preferably between 2% and 5% by weight. The weight ratio of the cationic fabric softener to the nonionic material should be less than 5:1, and preferably is greater than 1:1.

The electrolyte is selected from the salts of lithium, calcium, magnesium and aluminium and mixtures thereof. Aluminium salts are particularly preferred. Preferably the salts contain monovalent anions. Preferred examples include aluminium chloride, aluminium chlorhydrate, calcium chloride, calcium bromide, calcium nitrate and magnesium chloride. The preferred level of highly ionic electrolyte in the final product is at least 10 ppm and less than 3,000 ppm, most preferably 50 ppm to 2,000 ppm. In the case of electrolytes with a more covalent character such as aluminium chlorhydrate, the preferred level is at least 50 ppm and less than 12,000 ppm, most preferably from 120 to 6,000 ppm.

Where the cationic raw material used for making the product already contains electrolyte, we have found it to be of advantage if at least a portion of the added electrolyte contains the same cation. Thus, where for example the cationic raw material contains sodium ions, the added electrolyte preferably also contains some sodium ions, in admixture with an electrolyte containing lithium, calcium, magnesium or aluminium ions, such as calcium chloride. Similarly, when cationic raw material contains potassium ions, the added electrolyte advantageously also contains potassium ions.

The compositions of the invention may be prepared by forming a molten mixture of the cationic and nonionic components, dispersing this molten mixture in water at an elevated temperature, adding the electrolyte in the form of a concentrated aqueous solution and then cooling to ambient temperature. Alternatively, some of the electrolyte may be pre-dissolved in water.

It is particularly advantageous if the water to which the molten cationic/nonionic mixture is added already contains a dispersing aid. This dispersing aid should be a water-soluble non-anionic surfactant having an HLB of greater than 10, ideally greater than 12. In this context, the term "water-soluble" means having a solubility of more than 1.0 g/l in water at pH 2.5 and at 20° C. Preferred examples include water-soluble quaternary ammonium salts (such as Arquad 16, Arquad 2C), ethoxylated quaternary ammonium salts (such as Ethoquad 0/12), quaternary diamine and ethoxylated diamine salts (such as Duoquad T), ethoxylated amines and diamines (such as Ethoduomeen T/25, Ethomeen T/15) and their acid salts, ethoxylated fatty esters of polyhydric alcohols (such as sorbitan monolaurate 20 EO), ethoxylated fatty alcohols (such as Brij 58-cetyl alcohol 20 EO) and ethoxylated fatty acids (such as Myrj 49-stearic acid 20 EO).

A useful test for whether a particular material will be a suitable dispersing aid is one which results in a lower product viscosity after the addition of the electrolyte.

The dispersing aid may be present at a level of at least 0.1%, preferably at least 0.2% by weight based on the final product. Usually, it will not be necesary to use more than 2.5%, preferably not more than 1.0% dispersing aid.

The compositions may also contain one or more optional ingredients selected from non-aqueous solvents such as $C_1$–$C_4$ alkanols and polyhydric alcohols, pH buffering agents such as weak acids eg phosphoric, benzoic or citric acids (the pH of the compositions are preferably less than 6.0), rewetting agents, viscosity modifiers, antigelling agents, perfumes, perfume carriers, fluorescers, colourants, hydrotropes, antifoaming agents, antiredeposition agents, enzymes, optical brightening agents, opacifiers, stabilisers such as guar gum and polyethylene glycol, anti-shrinking agents, anti-wrinkle agents, fabric crisping agents, spotting agents, soil-release agents, germicides, fungicides, anti-oxidants, anti-corrosion agents, preservatives, dyes, bleaches and bleach precursors, drape imparting agents and antistatic agents.

The invention will now be illustrated by the following non-limiting examples, in which parts and percentages are by weight, based on the weight of the end product. Where materials are referred to by their commercial names, the percentages quoted are percentages of the active materials.

EXAMPLE 1

The following composition was prepared by forming a molten premix of the cationic fabric softener and the fatty acid. This premix was added to demineralised water at 60° C. After thorough mixing with a high speed constant torque stirrer the dispersion formed was allowed to cool to 25° C. Thereafter the electrolyte and perfume were added. The formulation was:

| | |
|---|---|
| Arquad 2T (di-soft tallow dimethyl ammonium chloride) | 10.9% |
| Pristerene 4916 (hardened tallow fatty acid) | 2.6% |
| Aluminium chloride | 0.08% |
| Perfume | 1.0% |
| Water | balance to 100% |

Similarly formulations were also prepared in which the aluminium chloride was replaced by 0.09% magnesium chloride, 0.1% calcium chloride and, for the sake of comparison, 0.1% sodium chloride.

The viscosity of each formulation was measured at 110 $sec^{-1}$ shear rate immediately after formation and then again after six weeks storage at room temperature.

The results were as follows:

| Electrolyte | Initial viscosity cP | Final viscosity cP |
|---|---|---|
| $AlCl_3$ | 26 | 27 |

-continued

| Electrolyte | Initial viscosity cP | Final viscosity cP |
|---|---|---|
| $MgCl_2$ | 25 | 36 |
| $CaCl_2$ | 28 | 42 |
| NaCl | 52 | 121 |

EXAMPLE 2

Similarly beneficial results can be obtained with the following formulations:

| | | |
|---|---|---|
| A. | Varisoft 475 (di-soft tallow imidazolinium methosulphate) | 14.5% |
| | Hardened rape seed fatty acid | 3.5% |
| | Calcium chloride or magnesium chloride | 0.2% |
| | Water | balance |
| B. | Arquad 2HT (di-hardened tallow dimethyl ammonium chloride) | 10.9% |
| | Pristerene 4916 | 2.6% |
| | Calcium chloride (added to the dispersion before cooling) | 0.03% |
| | Perfume | 0.72% |
| | Water | balance |
| | In this example the calcium chloride can be replaced by aluminium chloride to give even better storage stability. | |
| C. | Varisoft 455 | 12.2% |
| | Prifac 7962 (unhardened soyabean fatty acid containing 54% linoleic acid and 30% oleic acid) | 2.8% |
| | Calcium chloride | 0.2% |
| | Water | balance |
| D. | Arquad 2HT | 14.5% |
| | Pristerene 4916 | 3.5% |
| | Calcium chloride (added before cooling) | 0.05% |
| | Perfume | 1.0% |
| | Water | balance |

EXAMPLE 3

Compositions with the following formulations were prepared by the method described in Example 1. They illustrate the range of active levels and the range of cationic to nonionic ratios which are possible within the scope of this invention. In each case, the properties of the compositions were better than when sodium chloride was used as the electrolyte.

| Ingredients % | EXAMPLE NO | | | | |
|---|---|---|---|---|---|
| | 3A | 3B | 3C | 3D | 3E |
| Arquad 2T (soft) | 13.2 | 14.4 | 13.5 | 12.3 | 10.9 |
| Pristerene 4916 | 3.3 | 3.6 | 3.0 | 2.7 | 2.6 |
| $CaCl_2$ | 0.1 | 0.1 | 0.05 | 0.1 | 0.05 |
| $MgCl_2$ | — | — | — | — | 0.05 |
| Perfume | 1.0 | 1.0 | 1.0 | 0.8 | 1.0 |
| Water | balance to 100 | | | | |
| Total active | 16.5 | 18.0 | 16.5 | 15.0 | 13.5 |
| Cationic/nonionic ratio | 4 | 4 | 4.5 | 4.6 | 4.2 |
| | 3F | 3G | 3H | 3I | 3J |
| Arquad 2T (soft) | 10.4 | 10.5 | 10.5 | 12.3 | 12.3 |
| Pristerene 4916 | 3.1 | 3.0 | 3.0 | 2.7 | 2.7 |
| $MgCl_2$ | 0.045 | — | — | 0.09 | — |
| $AlCl_3$ | — | 0.04 | — | — | 0.08 |
| Aluminium chlorhydrate | — | — | 0.25 | — | — |
| Perfume | 0.75 | 0.75 | 0.75 | 0.8 | 0.8 |
| Water | balance to 100% | | | | |
| Total active | 13.5 | 13.5 | 13.5 | 15.0 | 15.0 |
| Cationic/Nonionic ratio | 3.4 | 3.5 | 3.5 | 4.6 | 4.6 |

EXAMPLE 4

Similarly beneficial results can be obtained by processing in the same manner compositions with the following formulations:

| Ingredients (%) | EXAMPLE NO | |
|---|---|---|
| | 4A | 4B |
| Arquad 2HT | 9 | 15 |
| Octadecanol | 3 | 5 |
| Calcium chloride | 0.06 | 0.1 |
| Perfume | — | 1.0 |
| Water | balance | |

In this Example the calcium chloride may be added after or (more preferably) before cooling the dispersion. Calcium chloride may be replaced by magnesium or aluminium chloride. Arquad 2HT may be replaced by Varisoft 445. The octadecanol may be replaced by glycerol monostearate or sorbitan monostearate. Any two or more of these modifications may be combined.

EXAMPLE 5

The benefit of including a dispersing aid in the water to which the active premix is added is illustrated as follows. An active premix was prepared by mixing 10.5 parts of Arquad 2HT with 2.5 parts Pristerene 4961 and heating to 70° C. This premix was then added to distilled water at 70° C. containing the dispersing aid. After stirring to form a dispersion in droplet form, calcium chloride was added to the hot mixture using a 10% solution. The end product composition was:

| | |
|---|---|
| Arquad 2HT | 10.5% |
| Pristerene 4916 | 2.5% |
| $CaCl_2$ | 0.03% |
| Dispersing aid | 0.5% |

After cooling to room temperature the viscosity of each product was measured at 110 $sec^{-1}$ at 25° C. Various materials were used as dispersing aids. The results were as follows:

| EXAMPLE NO | DISPERSING AID | (HLB) | VISCOSITY (cP) |
|---|---|---|---|
| 5A | Ethoduomeen T/25 | (18.5) | 40 |
| 5B | Myrj 49 | (15.0) | 30 |
| 5C | Brij 76 | (12.4) | 24 |
| 5D | None | (Control) | 204–240 |
| 5E | Span 20 | (8.6) | 351 |

In a further set of experiments using an apparatus of slightly different dimensions but otherwise using a similar technique, the results were:

| EXAMPLE NO | DISPERSING AID | (HLB) | VISCOSITY (cP) |
|---|---|---|---|
| 5F | Arquad 16 | (15.8) | 39 |
| 5G | Ethoquad 0/12 | (about 15) | 27 |
| 5H | Duomac T | (10.7) | 219 |
| 5I | None | (control) | 300 |

These results demonstrate that the product viscosity is lowered when the dispersing aid has an HLB of more than 10 (Example 5H for instance) but not when the dispersing aid is less than 10 (Example 5E). Also it is apparent that the benefit is most noticeable where the dispersing aid has an HLB above 12.0 (Examples 5A to 5C, 5F and 5G).

The dispersing aids used in this Example are commercial materials which are approximately as follows:

Ethoduomeen T/25: Ethoxylated N-tallowyl 1,3 propane diamine with 15 ethoxylene oxide groups per molecule.

Myrj 49: Ethoxylated stearic acid with 20 ethylene oxide groups per molecule.

Brij 76: Ethoxylated stearyl alcohol with 10 ethylene oxide groups per molecule.

Span 20: Sorbitan monolaurate.

Arquad 16: Cetyl trimethyl ammonium chloride.

Ethoquad 0/12: Oleyl, methyl bis(2 hydroxyethyl-)ammonium chloride.

Duomac T: N-tallowyl 1,3 propane diamine diacetate.

EXAMPLE 6

Softening tests were carried out comparing Arquad 2HT and Pristerene 4916 at various ratios, using the same total active level in the rinse liquor. The "scores" in the following Table are derived from a statistical analysis of a "round robin" test design and are normalised to zero for an unrinsed control. The higher the score the better the softening.

| Cationic/fatty acid weight ratio | Softening Score |
|---|---|
| Control | 0 |
| 8:1 | 1.55 |
| 6:1 | 1.78 |
| 4:1 | 1.94 |

-continued

| Cationic/fatty acid weight ratio | Softening Score |
|---|---|
| Arquad 2HT only | 1.07 |

These results demonstrate that improved softness performance can be obtained when the cationic to fatty acid ratio is below 5:1, and also that the softness obtained from such products is better than that obtained from the cationic softening agent alone.

We claim:

1. A concentrated liquid fabric softening composition comprising:

(i) an aqueous base;

(ii) at least 8% by weight of a water-insoluble cationic fabric softening agent;

(iii) a nonionic material having a HLB of not more than 10, selected from $C_8$–$C_{24}$ fatty acids, the weight ratio of the cationic fabric softening agent to the fatty acid being not more than 4.6:1; and (iv) from 10 ppm to 3,000 ppm of an electrolyte wherein said electrolyte is a salt of alumimium.

2. A composition according to claim 1, characterised in that the composition further contains an electrolyte selected from salts of sodium and potassium.

3. A composition according to claim 1, characterised in that the composition contains from 2% to 5% by weight of said nonionic material.

4. A composition according to claim 1, characterised in that the weight ratio of the cationic fabric softening agent to the nonionic material is greater than 1:1.

5. A composition according to claim 1, characterised in that it further contains at least 0.01% by weight of a dispersing aid.

6. A composition according to claim 1, characterised in that the dispersing aid is selected from water-soluble non-anionic surfactants having an HLB of more than 10.

* * * * *